United States Patent [19]

Southern

[11] Patent Number: 5,014,483

[45] Date of Patent: May 14, 1991

[54] APPARATUS FOR REPAIRING HOLES IN WOOD

[76] Inventor: Don L. Southern, 1918 Euharlee Rd., Kingston, Ga. 30145-2502

[21] Appl. No.: 446,089

[22] Filed: Dec. 5, 1989

[51] Int. Cl.[5] ..... E02D 37/00; B27G 1/00

[52] U.S. Cl. ..... 52/514; 52/750; 144/332; 144/346; 156/94; 156/98; 264/36; 428/63

[58] Field of Search ..... 144/2 R, 331, 332, 330, 144/346; 156/293, 94, 98; 428/63; 264/36; 521/79, 143; 52/514, 750

[56] References Cited

U.S. PATENT DOCUMENTS

| | | | |
|---|---|---|---|
| 2,536,665 | 1/1951 | Skoog | 144/332 |
| 2,788,813 | 4/1957 | Francar | 144/331 |
| 3,741,853 | 6/1973 | Forsythe et al. | 144/346 |
| 3,835,902 | 9/1974 | Elmendorf | 144/332 |
| 3,844,863 | 10/1974 | Forsythe et al. | 144/346 |
| 4,062,165 | 12/1977 | Marks et al. | 52/514 |
| 4,754,590 | 7/1988 | Gordon | 52/514 |

*Primary Examiner*—W. Donald Bray
*Attorney, Agent, or Firm*—John L. James

[57] ABSTRACT

An apparatus and method for repairing a knot hole in a piece of lumber includes a rod of compressible polyethylene material and an adhesive caulk. The caulk is applied to the knot hole. The rod is forcibly inserted into the knot hole being secured by a force fit and the adhesive caulk. The rod is cut flush with the surface of the wood being repaired. The surface can be stained or painted along with the remainder of the structure.

1 Claim, 1 Drawing Sheet

APPARATUS FOR REPAIRING HOLES IN WOOD

TECHNICAL FIELD

This invention relates generally to woodworking, and more particularly, to a method and apparatus for repairing knot holes and other voids and holes in lumber.

BACKGROUND OF THE INVENTION

Trees with limbs, such as cedar and pine, are widely used as building materials. A tree can be cut into boards or made into siding for use in houses and other buildings. When lumber is made, a knot occurs where a tree limb grew because of the difference in the direction of the grain of the wood. Unfortunately, knots have a way of becoming dislodged, after a while, leaving a knot hole in the lumber. Knot holes typically go unattended until the house or other structure containing the lumber needs refinishing. When refinishing is required, the holes are typically filled with caulk, putty or cement which is time consuming because the material is applied one layer at a time and allowed to set or cure between layers. The final layer is also allowed to cure a day before refinishing. It will be appreciated that it would be highly desirable to be able to repair a knot hole without having to wait several days for the filling material to cure.

In addition to knot holes, lumber can develop holes from insects, birds, squirrels and other animals. These holes, if relatively small, are filled with putty, cement or caulk. Larger holes are typically covered with a piece of sheet metal which is sometimes difficult to cut to the shape of the hole. Accordingly, it is desirable to have a repair apparatus and method that is simple and easy to use, does not require more than one application, and does not require several days to cure.

SUMMARY OF THE INVENTION

The present invention is directed to overcoming one or more of the problems set forth above. Briefly summarized, according to one aspect of the present invention, an apparatus for repairing a hole in a piece of wood comprises a rod of deformable material. The hole has a peripheral length. The rod has a first and second ends, a curvilinear cross section, and a circumferential length greater than the peripheral length the hole. The rod is deformable so that the first end fits snugly into the hole with the second end protruding from said hole to be cut off flush with said surface of the wood.

According to another aspect of the invention, a method for repairing a piece of wood having a surface and a hole therein with a peripheral length includes removing debris from the hole. The method further includes applying an adhesive compound to the hole, forcibly inserting a first end of a rod of material into the hole, and cutting off a second end of said rod of material flush with the surface of the wood.

The present invention provides a rod for plugging knot holes that reduces the amount of caulk required and thereby saves time and labor. The surface can be painted or stained immediately. The closed cell construction of the rod gives a neat appearance that is barely detectable from a viewing distance.

It is an object of the present invention to provide an apparatus and method for repairing a hole in a piece of lumber.

Another object of the invention is to to repair a knot hole without having to wait between layers for filling material to cure.

Another object of the invention is to provide a repair apparatus and method that is simple and easy to use, does not require more than one application, and does not require several days to cure.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
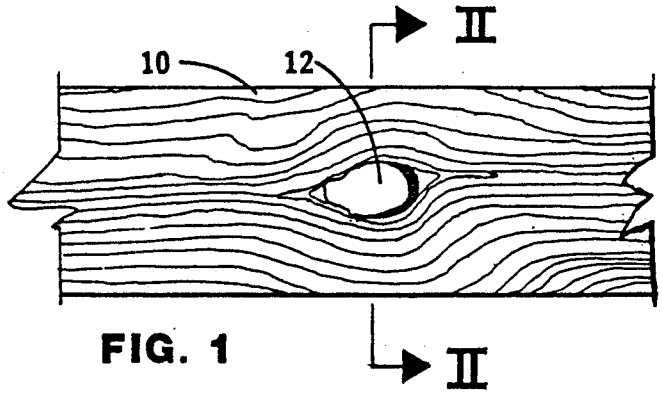
FIG. 1 is a front view of a piece of installed wood siding with a knot hole.

Referring now to the drawings, in which like numerals indicate like elements throughout the several figures, FIGS. 1 illustrates a section of lumber 10, such as a piece of siding of a house, with a knot hole 12 therein.

The board 10 is cut such that the grain of the wood runs lengthwise along the board 10. The grain of the knot that was in the knot hole 12 ran perpendicular to the grain of the board 10. Before the knot popped out of its hole 12, the grain was visible as circles which are the annual growth rings of the tree. The ring structure of the knot weakens the knot with respect to the remainder of the board 10 causing the knot to work its way free leaving the knot hole 12. The knot hole 12 is generally circular in configuration but may vary depending upon the particular type of wood and the growth conditions for the tree. Most knots, however, have a generally circular configuration.

Figure 2:
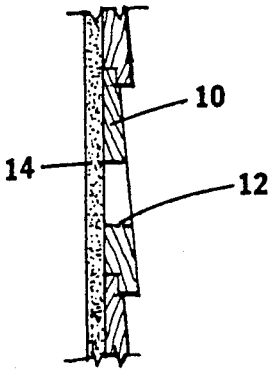
FIG. 2 is is a sectional view of the knot hole taken along line II—II of FIG. 1.

FIG. 2 is a sectional view of the knot hole 12 of the piece of lumber 10 taken along line II—II of FIG. 1. The siding 10 with the knot hole 12 is attached to a backer board 14. When the knot hole 12 occurs, the backer board 14 prevents the infiltration of air and water into the structure. The backer board 14 also provides a rigid backing surface for the siding 10 which may be relatively thin on the order of one-half inch or even less.

In the past, the knot hole 12 was repaired prior to refinishing the board 10. The process involved filling the hole 12 with caulk, cement, or another patching compound that was applied in several coats or layers. It was necessary to apply the patching compound in several layers because it was applied in a paste or semi-liquid form that would run or drip. Moreover, the patching compound had to be in layers to properly cure, with a curing time of about four to twenty-four hours per layer.

Figure 3:
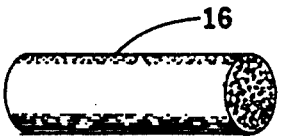
FIG. 3 is is a perspective view of a rod of hole plugging material.

Referring to FIG. 3, the present invention utilizes a rod 16 of deformable material, such as polyethylene, for example. It has been found that two pound density, expanded polyethylene foam works well. Polyurethane also works well. The polyethylene expanded foam is similar to a sponge being composed of a plurality of cells. The cells, however, are closed cells with a low moisture absorption rate on the order of about five per cent. The polyethylene expanded foam is preferably extruded into the rod 16 but may be extruded into other shapes. For repairing knot hole 12 having a circular configuration, the rod 16 works extremely well.

The cross sectional configuration of the rod 16 is preferably circular, but may be other curvilinear configurations such as an ellipse. The cross section configuration of the rod 16 may be any one of a number of plane conical sections ranging from a circle, to an oval, to an ellipse. It has been found convenient to package the rods 16 for use in sections that are about five inches long.

Figure 4:
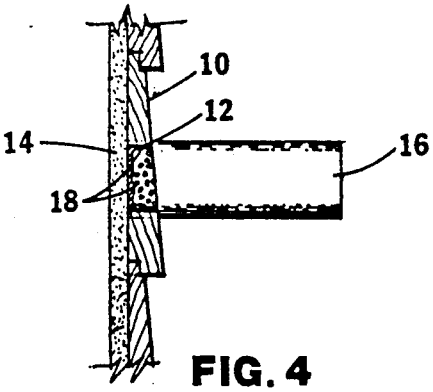
FIG. 4 is a sectional view similar to FIG. 2, but illustrating the rod inserted into the knot hole.
Figure 5:
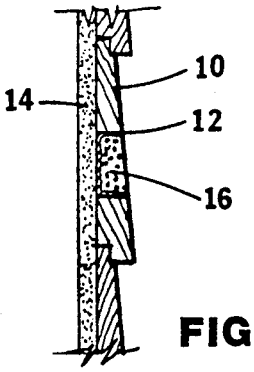
FIG. 5 is sectional view similar to FIG. 4, but with the rod cut flush with the surface of the wood siding.
Figure 6:
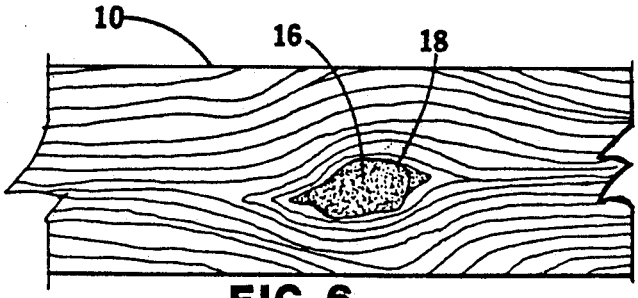
FIG. 6 is a front view similar to FIG. 1, but with the knot hole plugged with the rod of plugging material.

Referring now to FIGS. 4–6, the hole 12 in the board 10 is repaired by applying an adhesive compound 18, such as latex caulk for example, in the hole 12 and on the surface of the backer board 14 that is exposed through the hole 12. If there is no backer board 14, the adhesive compound is applied to the sides of the hole 12. The present invention works with or without a backer board. The rod 16 is then compressed and forced into the hole 12. The rod 16 of polyethylene expanded foam is preferably compressed such that its circumference is reduced in length by about ten to twenty per cent.

To begin the plugging operation, a rod 16 is selected with a circumference that is larger than the periphery of the opening 12 so that the rod 16 can be compressed ten to twenty per cent to achieve a force fit when inserted into the opening 12. The force fit helps prevent the rod 16 from becoming dislodged during use. If the circumference of the rod 16 is reduced less than about ten per cent, the rod 16 may become dislodged during use or upon exposure to the elements. If the circumference of the rod 16 is compressed more than about twenty per cent, the rod 16 becomes difficult to force into the opening 12 and leaves little room for the adhesive compound 18. Also, if the rod 16 is compressed more than about twenty per cent, it becomes difficult to cut smoothly.

After the rod 16 is forced into the hole 12, the portion of the rod 16 that protrudes from the hole 12 is removed by cutting with a sharp knife so that the surface of the rod 16 remaining in the hole 12 is flush with the surface of the board 10. After being cut, the exposed surface of the rod 16 may be treated with the adhesive caulk 18, and any excess caulk may be removed. Upon removal of the excess compound 18, the board 10 is ready for refinishing. The polyethylene expanded foam readily accepts both paint and stain, as does the latex caulk. The rod 16, after being installed in the hole 12, will expand to conform to the shape of the hole 12.

It will be now appreciated that there has been presented an apparatus and method for repairing a hole 12 in wood 10. The apparatus includes an adhesive compound 18 and a rod 16 of expanded foam material that is deformable to be forcibly inserted in the hole 12. After being cut to size, the deformable material 16 expands to conform to the shape of the hole 12.

The method for repairing a piece of wood 10 having a surface and a hole 12 therein with a peripheral length comprises removing debris from the hole 12, and applying an adhesive compound 18 to the hole 12. The method also includes forcibly inserting a first end of a length of material 16 into the hole 12, and cutting off a second end of the length of material 16 flush with the surface of the wood 10. The method further includes removing any excess adhesive compound 18, and spreading adhesive compound 18 over the deformable material 16 and over the surface of the wood 10 adjacent the hole 12. The step of forcibly inserting the length of material 16 into the hole 12 includes squeezing the material 16 and reducing its circumferential length ten to twenty per cent.

The present invention permanently repairs holes in wood, and repairs the holes in such a way that the wood can be refinished with the repair being practically undetectable from a normal viewing distance, such as the distance a house sits from the street. The adhesive compound 18 is applied only to the sides and back of the hole 12, and is not used to completely fill the void 12. The adhesive compound 18 is thereby used sparingly relying on the rod 16 of deformable material to fill most of the void 12. Filling the void in this manner reduces the amount of expensive caulk 18 required, and results in only one layer of caulk 18 being required. This saves both labor and material. Where it is desired to complete the repair as quickly as possible, the step of applying the adhesive compound 18 to the exposed surface of the rod 16 and surface of the board 10 adjacent the hole 12 may be omitted. Also, a paint-over caulk compound can be used that can be painted or stained immediately without curing.

While the invention has been described with reference to a knot hole in a board, it will be apparent to those skilled in the art that the apparatus and method of the present invention can be adapted to any size hole in a board. Typical holes larger than a knot hole may include holes made by the woodpeckers and squirrels. These holes are treated in the same manner by using a rod 16 having a larger circumferential length than the hole to be repaired. Also, if the particular hole varies greatly from being circular, a rod 16 may be fashioned that more nearly matches the configuration of the hole.

While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the invention has been described with particular emphasis on knot holes in siding, but is equally applicable to any hole in wood regardless of the origin of the hole. It is accordingly intended that the claims shall cover all such modifications and applications as do not depart from the true spirit and scope of the invention.

I claim:

1. An apparatus for repairing a piece of wood having a surface and a hole therein with a peripheral length, comprising:

a rod of closed cell polyethylene foam material having a moisture absorption of less than about five percent, and having a first end and a second end and having a curvilinear cross section and a circumferential length ten to twenty percent greater than said peripheral length of said hole, said rod being deformable so that said first end fits snugly into said hole with said second end protruding from said hole to be cut off flush with said surface of said wood, said rod expanding after being cut to conform to the shape of said hole.

* * * * *